United States Patent [19]

Centafanti

[11] Patent Number: 4,579,335

[45] Date of Patent: Apr. 1, 1986

[54] METHOD OF AND APPARATUS FOR USE IN EXERCISING AND IN COMPETITION

[76] Inventor: Rocco Centafanti, 27 India St., Portland, Me. 04101

[21] Appl. No.: 579,451

[22] Filed: Feb. 13, 1984

[51] Int. Cl.[4] ..... A63B 23/06

[52] U.S. Cl. ..... 272/69; 272/93; 272/70; 272/73; 272/130; 73/379; 417/63; 272/DIG. 6

[58] Field of Search ..... 272/69, 130, 73, 99, 272/DIG. 5, DIG. 6, 70, 93; 73/379, 168; 417/63

[56] References Cited

U.S. PATENT DOCUMENTS 482,623 9/1892 Dooling ..... 272/130 X 747,294 12/1903 Blaisdell ..... 272/73

3,395,698 8/1968 Morehouse ..... 272/73 X 3,529,474 9/1970 Olson et al. ..... 272/130 X

FOREIGN PATENT DOCUMENTS 1913031 9/1970 Fed. Rep. of Germany ..... 73/379

*Primary Examiner*—Richard J. Apley

*Assistant Examiner*—David J. Brown

[57] ABSTRACT

In exercising and in competition with another using like captive apparatus of a type having a shaft rotated by the user, performance is measured by utilizing the rotation of the shaft to effect the pumping of a predetermined volume of a fluid as one objective and, as other objectives, timing the interval required to attain that volume or to establish a time limit for operating the apparatus.

7 Claims, 3 Drawing Figures

METHOD OF AND APPARATUS FOR USE IN EXERCISING AND IN COMPETITION

BACKGROUND REFERENCES

U.S. Pat. No. 2,042,764
U.S. Pat. No. 3,082,264
U.S. Pat. No. 3,494,616
U.S. Pat. No. 3,572,700
U.S. Pat. No. 3,592,466
U.S. Pat. No. 4,241,913

BACKGROUND OF THE INVENTION

Exercising devices such as treadmills and exercising bicycles both have the advantage that they permit indoor exercising with minimum space requirements with the exercising effort adapted to the desires or needs of the users. Each such device has a shaft rotated as a consequence of its use and typically has an adjustable resistance to vary the required or desired exercising effort. Such devices have the distinct disadvantage that their use is monotonous.

THE PRESENT INVENTION

The general objective of the present invention is to enable exercising devices such as pedal operated and treadmill types to be used with monotony eliminated from their use.

In terms of method, the invention utilizes the rotation of a shaft of a captive exercising device to effect the pumping of a fluid and the measurement of the pumped volume with the achievement, the pumping of a predetermined volume, the time required to pump that volume, or the volume pumped during a timed exercising interval whether one is exercising by himself or in competition with another.

In terms of apparatus, the invention provides captive exercising devices of any type that have a shaft rotated by the user while exercising and a fluid delivery system having a pump operated by the rotation of the shaft and means to measure the pumped volume. As an important objective of the invention is to provide criteria other than the pumping of a predetermined volume, the apparatus is provided with a timer to enable an exercising interval or the pumping of a predetermined volume to be timed whether or not one is using the apparatus in competition with another operating a like device.

Another important objective of the invention is to provide a pumping system that meets manufacturing requirements as well as those of the users and that can be added to existing devices. This objective is attained, when the fluid to be pumped is a liquid, by the use of a reservoir, a receiver, and delivery and return conduits. The delivery conduit includes the pump and preferably has a valve preventing return flow therethrough and the return conduit has a shut off valve. In order that the receiver can best serve as the measuring means it is of a type having vertically spaced graduations and permitting the filling of the receptacle to be readily observed and desirably is of relatively small cross sectional area as compared to its height and is located where its filling may be easily observed by the operator while exercising.

Other objectives of the invention and the manner of their attainment will be apparent from the following specification and the appended claims.

PRIOR ART STATEMENT

As far as I am aware, no prior art is known relevant to the invention as defined by the appended claims.

Such patents as have been cited are of interest only in that they disclose fluid circulating means that are operable only to vary the resistance to the operation of exercising devices by the user.

BRIEF DESCRIPTION OF THE DRAWINGS

The accompanying drawings illustrate a preferred embodiment of the invention in which the exercising device is shown as of the treadmill type only in order to simplify the disclosure.

Of the drawings.

THE PREFERRED EMBODIMENT OF THE INVENTION

Figure 1:
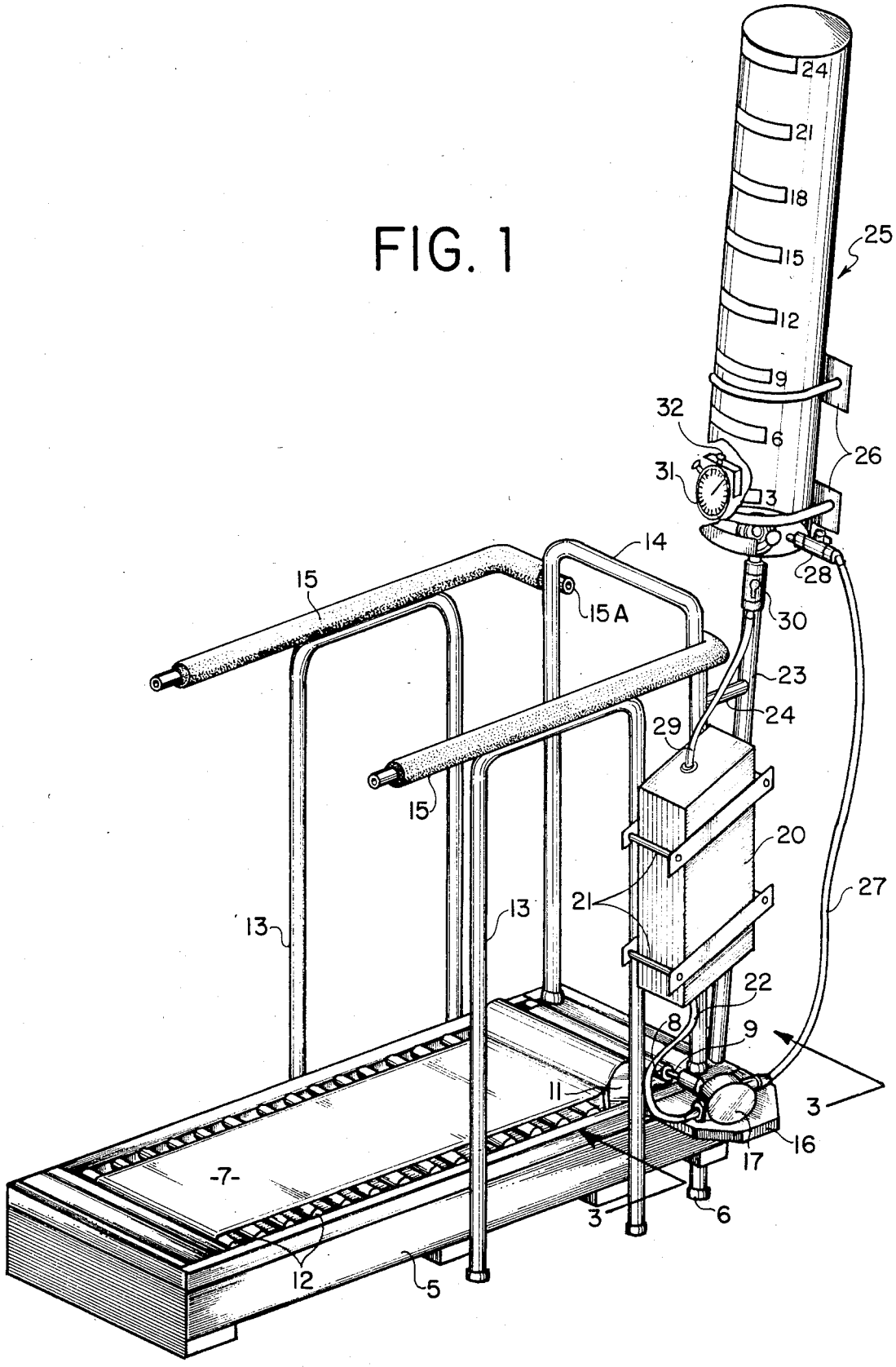
FIG. 1 is a perspective of the device and attached apparatus as viewed from the rear.
Figure 2:
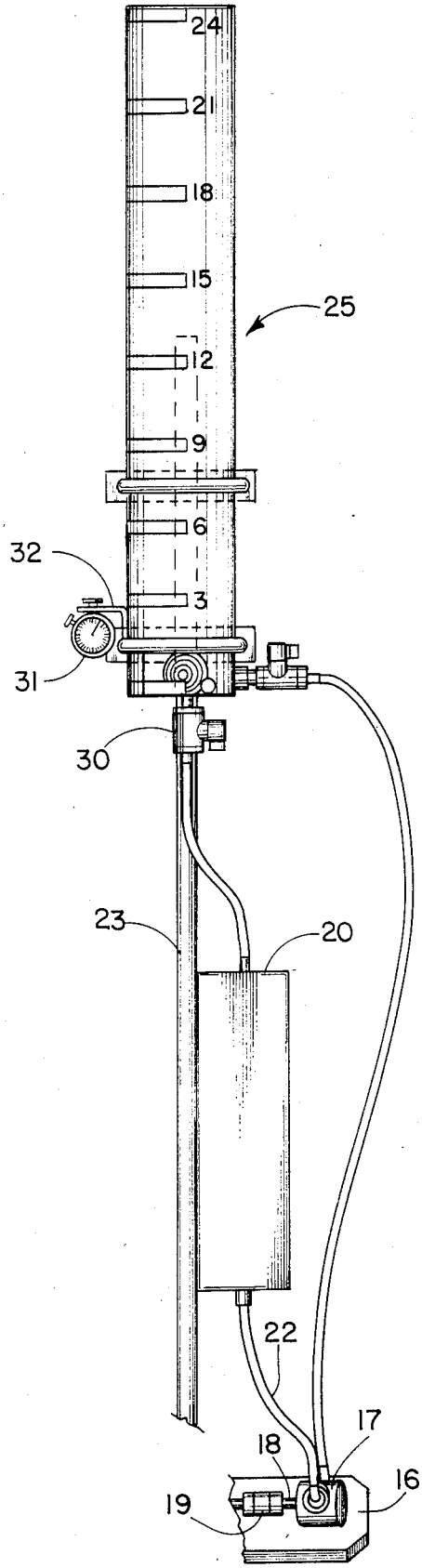
FIG. 2 is a view of the assembled apparatus detached from the device.

A typical treadmill has a base 5 supported at its front end by legs 6 thus to be slightly upwardly and forwardly inclined. A belt 7 is trained about a roller 8 on a front shaft 9, in support of a shaft 10, a larger roller 11, and a rearward series of closely spaced smaller rollers 12. Such treadmills conventionally have means by which wanted resistances to the efforts of the users may be established but such means and other features of a treadmill are not shown or described as unnecessary to an appreciation of the present invention and forming no part thereof.

A frame 13 in the form of an inverted U is connected to each side of the base 5 and a like but somewhat taller frame 14 is attached to the front thereof. Padded side rails 15 are secured to the closed ends of the frame 13 and the ends 15A of the side rails are connected to the front frame 14 close to but below its closed end.

Figure 3:
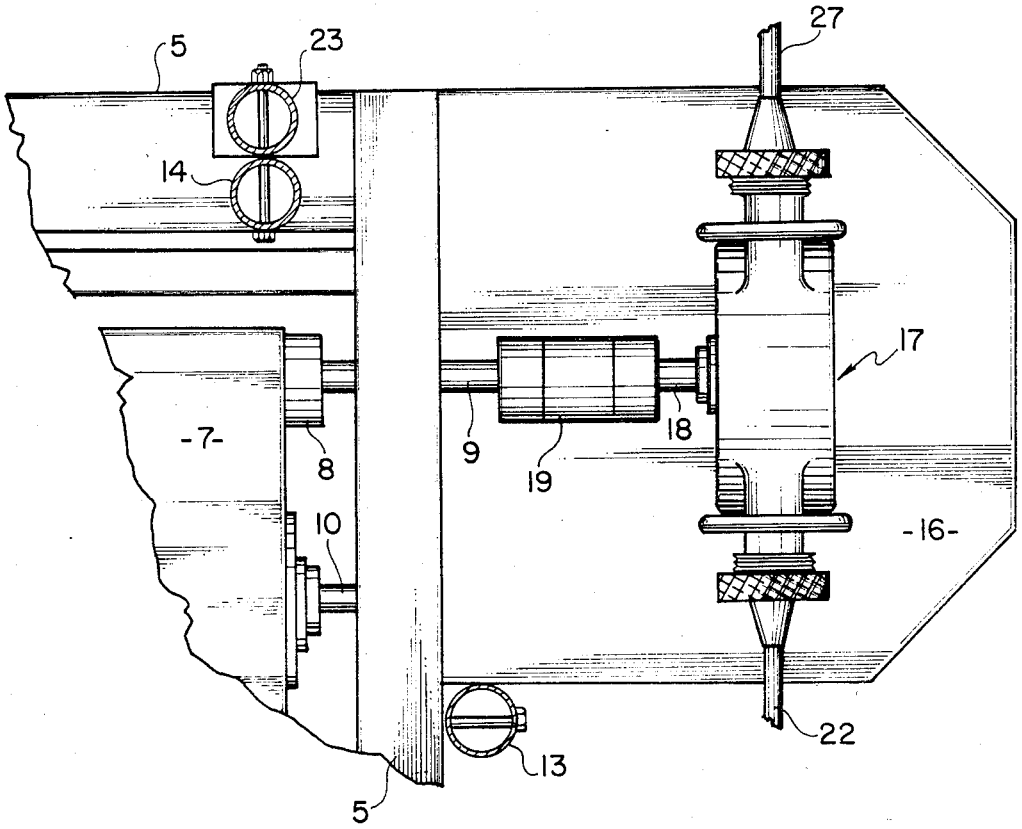
FIG. 3 is a section, on an increase in scale taken approximately along the indicated line 3—3 of FIG. 1.

In accordance with the invention, a shelf 16 is attached to one side of the base 5 close to the front thereof and a pump 17 is mounted thereon with its drive shaft 18, see FIG. 3, connected to the shaft 9 by a coupling 19. A reservoir 20 secured by clamps 21 to adjacent members of the frame 13 at that side and of the front frame 14 is placed in communication with the intake of the pump 17 by a conduit 22.

An upright 23, secured to the base 5 and to the lower end of the adjacent portion of the front frame 14 is also secured to that portion at a higher location by a brace 24 to ensure that the upright is securely held vertically. The upright 23 extends a substantial distance above the closed end of the frame 14 and has an open receiver 25 anchored thereto as by clamps 26.

A delivery conduit 27 places the bottom end of the receiver 25 in communication with the outlet of the pump 17 and is provided with a valve 28 which is shown as manually operable but which may be a check valve to prevent return flow through the conduit 27, a requirement for most uses as will subsequently be apparent. A circulating loop for liquid in the reservoir 20 is completed by a return conduit 29 effecting communication between the receiver 25 and the reservoir 20 with the return conduit 29 provided with a manually operable valve 30 by which return flow from the receiver 20 may be permitted or prevented.

The receiver 25 is shown as tubular but the essential requirements for it are that its cross sectional area be small as compared to its height and that it be sufficiently translucent to enable the liquid level therein to be easily monitored. In practice, the liquid is colored and the receiver 25 has vertically spaced graduations, desirably in the form of bands. With the receiver 25 mounted as shown, its filling may be readily observed by the user operating the device.

In order that exercising or competitive uses of the invention may be timed, a timer 31 is provided and shown as attached by a bracket 32 to the lower clamp 26 thus to be where it may be constantly observed and where it is readily accessible for manual operation.

In use, the person exercising may simply operate the device at any desired rate until the receiver 25 is filled to a predetermined level. The use of the timer 31 has the advantage that it enables the exercising interval required to effect the filling of the receiver to a predetermined level to be timed or an exercising interval established with the volume pumped in that interval, the achievement. Each such use may be used as a basis for competition with another using a like device in accordance with the invention.

I claim:

1. Apparatus including a captive exercising device having a shaft rotated by the user thereof, a pump connected to said shaft, a liquid reservoir and liquid delivery means including said pump the intake of which is in communication with said reservoir, a receiver, a delivery conduit effecting communication between the discharge of said pump and the receiver, a return conduit effecting communication between the receiver and the reservoir, and valve means normally operable to prevent flow from said receiver to said reservoir, said receiver of a type measuring the pumped volume.

2. The apparatus of claim 1 in which the delivery conduit includes a valve between the receiver and the pump operable to prevent return flow therethrough and the return conduit has a manually operated valve operable to block or permit return flow therethrough.

3. The apparatus of claim 1 in which the receiver includes means attached to the device and supporting the receiver in a position to be observed by the user while the device is in use and the receiver is of a type enabling the liquid level therein to be observed.

4. The apparatus of claim 3 in which the receiver is of a height sufficiently greater than the cross sectional area thereof so that the rate at which the receiver fills is readily noticeable.

5. Apparatus for use with a captive exercising device having a shaft rotated by the user thereof, said apparatus including a pump adapted to be attached to said shaft, a reservoir for a liquid, means operable to place the intake of the pump in communication with the reservoir, a receiver, a delivery conduit effecting communication between the discharge of the pump and the receiver, a return conduit effecting communication between the receiver and the reservoir, valve means normally operable to prevent return flow from the receiver, and means to attach said pump, reservoir and receiver to said device.

6. The apparatus of claim 5 in which the valve means includes a valve in said delivery conduit operable to prevent return flow therethrough and a manually operable valve in the return conduit operable to block or permit return flow therethrough.

7. The apparatus of claim 5 in which the attaching means for the receiver is operable when attached to the device to support the receiver in a position to be observed by the user of the device and the receiver is of a type enabling the liquid level therein to be observed and the height of the receiver is substantially greater than the cross sectional area thereof.

* * * * *